United States Patent [19]

Starkey, IV et al.

[11] Patent Number: 4,775,859

[45] Date of Patent: Oct. 4, 1988

[54] PROGRAMMABLE INTERLACE WITH SKIP AND CONTRAST ENHANCEMENT IN LONG PERSISTENCE DISPLAY SYSTEMS

[75] Inventors: Cornelius J. Starkey, IV; Hubbard B. T. Spencer, III; Thomas J. McSorley; James P. Galvin, Jr., all of Lexington, Ky.

[73] Assignee: Hilliard-Lyons Patent Management, Inc., Louisville, Ky.

[21] Appl. No.: 788,838

[22] Filed: Oct. 18, 1985

[51] Int. Cl.[4] ..... G09G 1/04

[52] U.S. Cl. ..... 340/732; 340/736; 340/797

[58] Field of Search ..... 340/720, 723, 732, 736, 340/742, 744, 797, 706, 708, 721; 358/119, 137, 258, 288, 140

[56] References Cited

U.S. PATENT DOCUMENTS

| | | | |
|---|---|---|---|
| 2,879,324 | 3/1959 | Hoffmann et al. | 358/119 |
| 3,339,017 | 8/1967 | Quinlan | 358/137 |
| 3,410,953 | 11/1968 | Quinlan | 358/137 |
| 3,448,207 | 6/1969 | Green et al. . | |
| 3,502,803 | 3/1970 | Bigenwald et al. . | |
| 3,705,263 | 12/1972 | Rittenhouse | 340/797 |
| 3,932,592 | 1/1976 | Todd, Jr. et al. . | |
| 3,955,045 | 5/1976 | Ford, Jr. . | |
| 3,959,584 | 5/1976 | Todd, Jr. | 313/465 |
| 4,047,204 | 9/1977 | Gold | 358/93 |
| 4,146,878 | 3/1979 | MacArthur | 340/736 |
| 4,157,537 | 6/1979 | Cheek et al. | 340/797 |
| 4,222,048 | 9/1980 | Johnson et al. | 315/367 |
| 4,228,432 | 10/1980 | Osborne | 340/736 |
| 4,302,781 | 11/1981 | Ikeda et al. | 358/288 |
| 4,408,197 | 10/1983 | Komatsu et al. | 340/720 |
| 4,413,287 | 11/1983 | Torpie et al. | 358/258 |
| 4,464,682 | 8/1984 | Etoh et al. | 358/288 |
| 4,550,315 | 10/1985 | Bass et al. | 340/721 |
| 4,642,626 | 2/1987 | Bruce | 340/723 |

*Primary Examiner*—Gerald L. Brigance
*Assistant Examiner*—Jeffery A. Brier
*Attorney, Agent, or Firm*—Kerkam, Stowell, Kondracki & Clarke

[57] ABSTRACT

Disclosed are systems and techniques for image generation applicable in general to any long persistence display device, particularly one in which contrast builds over a number of frames. The display device disclosed in detail by way of example herein is a high resolution cathodochromic CRT (CCRT) in a projection system. The system includes a deflection generator for the display device capable of writing to at least individual image lines in any order and, in some embodiments, to individually-addressed pixels. In raster-scanned embodiments, an image memory is included, capable of storing pixel data on a line-by-line basis. An image controller serves to read particular lines from the image memory and to write corresponding image lines on the display device. In one embodiment, those scan lines which have no picture information (e.g. all white lines in the case of a CCRT) are skipped as lines are read from the image memory and written to the display device, substantially increasing the frame refresh rate in the time-critical operation of writing to a CCRT. The skipping of lines is perferably implemented by storing a "skip word" with each line of pixel data in the image memory, each skip word indicating a particular successive line to scan, and thus which lines to skip. The use of "skip words" also permits programmable interlace to be implemented. "Rolling writing" techniques of the invention facilitate display of partial raster images which become available line-by-line over a period of time, as well as point writing for annotation.

11 Claims, 8 Drawing Sheets

12
CCRT
HORIZONTAL DRIVE
VERTICAL DRIVE
VIDEO DRIVE
64
DIGITAL TO ANALOG CONVERSION
62
X & Y DATA
X CLOCK
Y CLOCK
VIDEO
VIDEO SHIFT REGISTER
70
66
IMAGE GENERATOR CONTROLLER
SKIP WORDS
IMAGE DATA
SKIP WORDS
60
IMAGE MEMORY
IMAGE PIXEL DATA
68000 CPU DATA BUS
68000 CPU ADDRESS BUS
FIFO
68
72
74
76
HOST CPU INCLUDING IMAGE ANALYSIS 68000
DMA CONTROLLER
78

FIG 3A
PRIOR ART

| LINES TO BE SCANNED | LINE NO. | BIT MAP DATA |
|---|---|---|
| √ | 1 | |
| √ | 2 | |
| √ | 3 | xxxxxxxxxxxxxxxxxxxxxxxxx |
| √ | 4 | |
| √ | 5 | |
| √ | 6 | xxxxxxxxxxxxxxxxxxxxxxxxx |
| √ | 7 | xxxxxxxxxxxxxxxxxxxxxxxxx |
| √ | 8 | xxxxxxxxxxxxxxxxxxxxxxxxx |
| √ | 9 | xxxxxxxxxxxxxxxxxxxxxxxxx |
| √ | 10 | |
| √ | 11 | |
| √ | 12 | |
| √ | 13 | |
| √ | 14 | xxxxxxxxxxxxxxxxxxxxxxxxx |
| √ | 15 | xxxxxxxxxxxxxxxxxxxxxxxxx |
| √ | 16 | |
| √ | 17 | xxxxxxxxxxxxxxxxxxxxxxxxx |
| √ | 18 | xxxxxxxxxxxxxxxxxxxxxxxxx |

FIG 3B
PRIOR ART

SCAN ORDER: 1,2,3,4,5,6,7,8,9,10,11,12,13,14,15,16,17,18,1,2
FIELD NO. :
FRAME NO.:

SCAN ORDER: 1,3,5,7,9,11,13,15,17,2,4,6,8,10,12,14,16,18,1,3
FIELD NO.:
FRAME NO.:

FIG 3C
PRIOR ART

FIG 4A

| LINES TO BE SCANNED | LINE NO. | BIT MAP DATA | SKIP WORD |
|---|---|---|---|
| ✓ | 1 | | 2 |
| ✓ | 2 | | 2 |
| ✓ | 3 | xxxxxxxxxxxxxxxxxxxxxxxxx | 2 |
| ✓ | 4 | | 2 |
| ✓ | 5 | | 2 |
| ✓ | 6 | xxxxxxxxxxxxxxxxxxxxxxxxx | 2 |
| ✓ | 7 | xxxxxxxxxxxxxxxxxxxxxxxxx | 2 |
| ✓ | 8 | xxxxxxxxxxxxxxxxxxxxxxxxx | 2 |
| ✓ | 9 | xxxxxxxxxxxxxxxxxxxxxxxxx | 2 |
| ✓ | 10 | | 2 |
| ✓ | 11 | | 2 |
| ✓ | 12 | | 2 |
| ✓ | 13 | | 2 |
| ✓ | 14 | xxxxxxxxxxxxxxxxxxxxxxxxx | 2 |
| ✓ | 15 | xxxxxxxxxxxxxxxxxxxxxxxxx | 2 |
| ✓ | 16 | | 2 |
| ✓ | 17 | xxxxxxxxxxxxxxxxxxxxxxxxx | X |
| ✓ | 18 | xxxxxxxxxxxxxxxxxxxxxxxxx | X |

X= DON'T CARE

FIG 4B

SCAN ORDER 1,3,5,7,9,11,13,15,17,2,4,6,8,10,12,14,16,18,1,3

FIELD NO. ← 1 → ← 2 →

FRAME NO. ← 1 →

FIG 5A

| LINES TO BE SCANNED | LINE NO. | BIT MAP DATA | SKIP WORD |
|---|---|---|---|
| ✓ | 1 | | 4 |
| ✓ | 2 | | 2 |
| ✓ | 3 | xxxxxxxxxxxxxxxxxxxxxxxxxx | 2 |
| ✓ | 4 | | 2 |
| | 5 | | X |
| ✓ | 6 | xxxxxxxxxxxxxxxxxxxxxxxxxx | 6 |
| ✓ | 7 | xxxxxxxxxxxxxxxxxxxxxxxxxx | 6 |
| ✓ | 8 | xxxxxxxxxxxxxxxxxxxxxxxxxx | 4 |
| ✓ | 9 | xxxxxxxxxxxxxxxxxxxxxxxxxx | 2 |
| | 10 | | X |
| | 11 | | X |
| | 12 | | X |
| | 13 | | X |
| ✓ | 14 | xxxxxxxxxxxxxxxxxxxxxxxxxx | 2 |
| ✓ | 15 | xxxxxxxxxxxxxxxxxxxxxxxxxx | 2 |
| | 16 | | X |
| ✓ | 17 | xxxxxxxxxxxxxxxxxxxxxxxxxx | X |
| ✓ | 18 | xxxxxxxxxxxxxxxxxxxxxxxxxx | X |

X= DON'T CARE

FIG 5B

SCAN ORDER 1,3,7,9,15,17,2,4,6,8,14,18,1,3

FIELD NO.. ← 1 → ← 2 →

FRAME NO. ← 1 →

POINT REFRESH BUFFER MEMORY CONTENTS

| POINT | | | | |
|---|---|---|---|---|
| 1 | X PIXEL POSITION | Y PIXEL POSITION | REFRESH COUNT | DELAY FACTOR |
| 2 | X PIXEL POSITION | Y PIXEL POSITION | REFRESH COUNT | DELAY FACTOR |
| 3 | X PIXEL POSITION | Y PIXEL POSITION | REFRESH COUNT | DELAY FACTOR |
| 4 | X PIXEL POSITION | Y PIXEL POSITION | REFRESH COUNT | DELAY FACTOR |
| 5 | X PIXEL POSITION | Y PIXEL POSITION | REFRESH COUNT | DELAY FACTOR |
| 6 | X PIXEL POSITION | Y PIXEL POSITION | REFRESH COUNT | DELAY FACTOR |
| 7 | X PIXEL POSITION | Y PIXEL POSITION | REFRESH COUNT | DELAY FACTOR |
| 8 | X PIXEL POSITION | Y PIXEL POSITION | REFRESH COUNT | DELAY FACTOR |

FIG 6

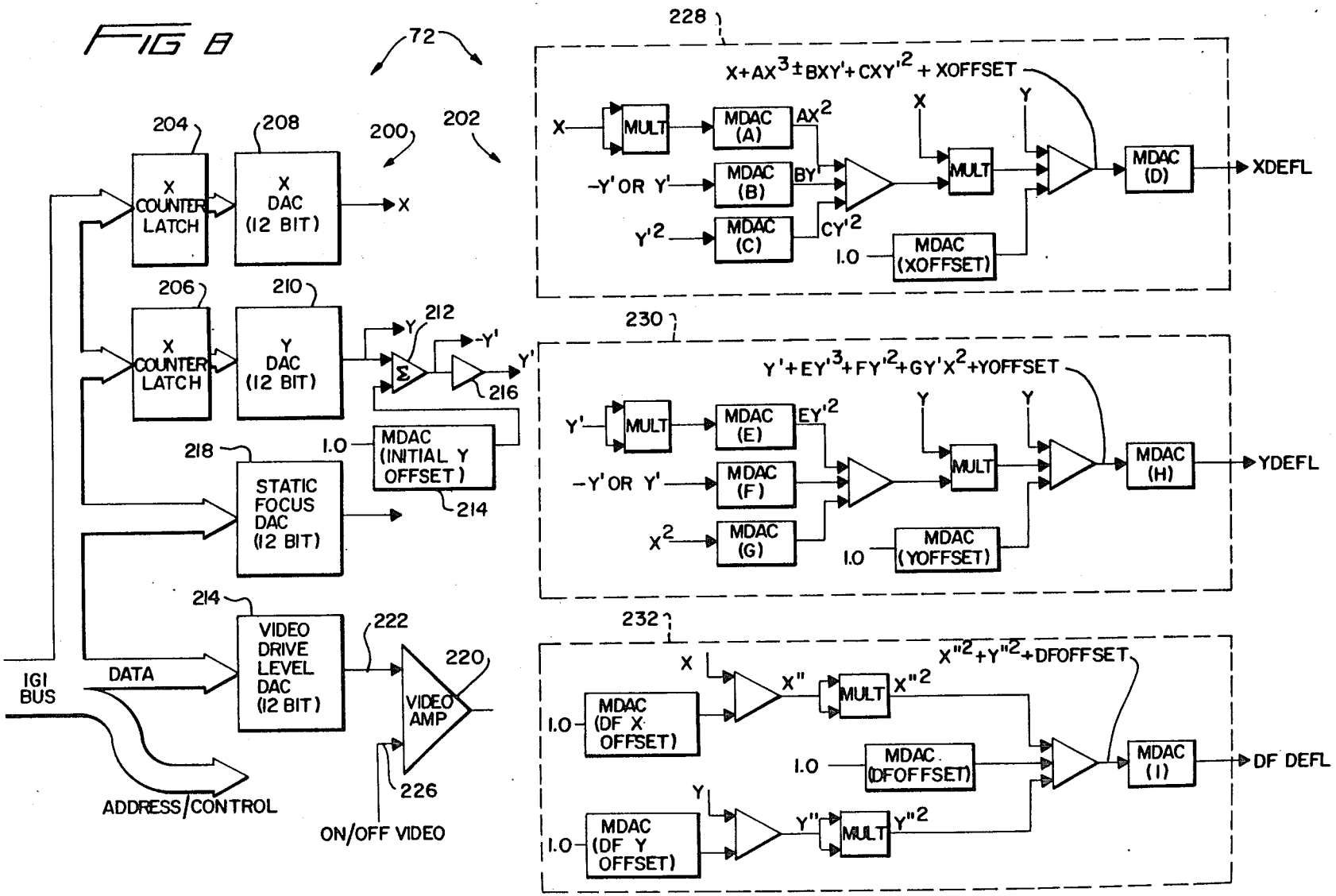
FIG 8
72
200
202
X
X COUNTER LATCH
204
X DAC (12 BIT)
208
Y COUNTER LATCH
206
Y DAC (12 BIT)
210
Y
-Y'
Y'
212
216
MDAC (INITIAL Y OFFSET)
214
1.0
STATIC FOCUS DAC (12 BIT)
218
VIDEO DRIVE LEVEL DAC (12 BIT)
214
222
VIDEO AMP
220
226
ON/OFF VIDEO
DATA
ADDRESS/CONTROL
IGI BUS
228
X+AX3±BXY'+CXY'2 + XOFFSET
MULT
-Y' OR Y'
Y'2
MDAC (A)
MDAC (B)
MDAC (C)
AX2
BY'
CY'2
MULT
MDAC (XOFFSET)
1.0
MDAC (D)
XDEFL
230
Y'+EY'3+FY'2+GY'X2+YOFFSET
MULT
-Y' OR Y'
X2
MDAC (E)
MDAC (F)
MDAC (G)
EY'2
MULT
MDAC (YOFFSET)
1.0
MDAC (H)
YDEFL
232
X"2+Y"2+DFOFFSET
MULT
MDAC (DF X OFFSET)
MULT
MDAC (DFOFFSET)
MULT
MDAC (DF Y OFFSET)
X"2
Y"2
1.0
MDAC (I)
DF DEFL

PROGRAMMABLE INTERLACE WITH SKIP AND CONTRAST ENHANCEMENT IN LONG PERSISTENCE DISPLAY SYSTEMS

CROSS-REFERENCE TO RELATED APPLICATION

This is a companion to related application Ser. No. 789,107, filed Oct. 18, 1985 by Cornelius J. Starkey, IV, and entitled "CRT Display System with Automatic Alignment Employing Personality Memory", the entire disclosure of which is hereby expressly incorporated by reference.

BACKGROUND OF THE INVENTION

The present invention relates to image generation techniques for electronic displays. More particularly, the invention relates to programmable interlace with optional skipping of non-information carrying lines in a raster-scanned display, to a related contrast enhancement technique herein termed "rolling writing", and to direct point writing techniques. While techniques of the invention are applicable to any long-persistence display, the specific example disclosed in detail herein is a cathodochromic CRT display, which has an infinitely long persistence, until it is deliberately erased.

Most CRT based display systems, as well as some flat panel displays, use the raster scan technique of image generation. Raster scan in a CRT employs a scanning electron beam to write an image on the phosphor-coated face of the CRT a line at a time from top to bottom. In CRTs with short duration phosphors, like a television set, this process is repeated at fairly high rates, 30 to 60 times per second. The high rate is needed to reduce flicker in the image caused by the fading of the light emitted by the relatively short persistence phosphor after it is hit by the scanning electron beam. Longer duration phosphers are not used in conventional television because they would preclude motion in the generated image.

If all lines of the image are scanned sequentially in one pass from top to bottom, the generated image by definition has a 1:1 interlace ratio. If the image is generated in two passes, one pass doing the odd lines and the other doing the even lines, then by definition the generated image has a 2:1 interlace ratio. The entire generated image is called a frame. If a 2:1 interlace, or higher, is used, each pass is called a field and the display must show "n" fields to make a complete frame, where "n" is the interlace ratio. Interlace is used to reduce flicker by increasing the apparent refresh rate and lower the bandwidth requirements of the display electronics. U.S. standard television uses a 2:1 interlace. Interlace ratios higher than 2:1 are very rarely used in displays, and 1:1 is used in most high resolution applications.

In storage and long persistence displays higher interlace factors can be useful. Since the images used are static, a detailed high resolution image can be generated at higher interlace factors providing a low resolution image very quickly. The image then becomes more detailed as the subsequent fields are scanned.

As noted above, while the invention is applicable to any long-persistence display system, the particular application described herein is a high resolution cathodochromic CRT projection display system. Accordingly, several characteristics of such a display will now be summarized.

An image target on which an electron beam impinges in a cathodochromic CRT does not emit light as does an image target in a cathodoluminescent CRT. Rather, the cathodochromic materials employed change color when excited by an electron beam. In the case of an image target comprising cathodochromic bromine sodalite, the resultant coloration remains indefinitely, until deliberately erased. In addition to inherent memory, cathodochromic image targets have the properties of high resolution, and high contrast in bright ambient light making them highly suitable for projection systems.

Erasure of a cathodochromic image target is normally effected by heating to about 300° C. An economical and technically feasible erasure method is electron beam heating, wherein the image target is scanned, in a raster pattern, with an electron beam spot energy density such that temperature is raised above an erase threshold.

Processes for preparing cathodochromic sodalite and a cathodochromic CRT projection display are disclosed in Todd, Jr. et al U.S. Pat. No. 3,932,592 and Todd, Jr. U.S. Pat. No. 3,959,584 to which reference may be had for further details.

Considering cathodochromic CRT display characteristics in greater detail as they relate to the present invention, the darkness of the black pixels is a function of electron beam exposure time, electron beam current level, and the temperatur of that pixel. The longer the exposure, the darker the pixel gets, so long as the temperature of the cathodochromic material at that pixel site remains under the erase threshold temperature. A problem with long exposure times is that the material is heated by the electron beam to the point where it loses contrast (erases). This problem is exacerbated by the use of a thermal insulation or buffer layer between the sensitized cathodochromic material and the underlying support, as is disclosed in the above-referenced Todd, Jr. U.S. Pat. No. 3,959,584. The thermal buffer layer aids in electron beam erasure, but does complicate the writing process if good contrast is to be achieved. Thus, multiple short exposures of a high current electron beam separated by a relatively long cooling period are necessary for building good contrast. Typically, from 40 to 300 exposures per pixel may be employed in a raster-scanned display before the final contrast is achieved.

As a simple example, a 100 nanosecond exposure with a delay of 100 miliseconds before the next exposure is fairly typical. This provides a cooling delay of 1,000,000 times the exposure time. Carrying this example further, if the display comprises 1,000 lines of 1,000 pixels each, a conventional raster scan would ideally expose each pixel once every 100 milliseconds (1,000,000 pixels × 100 nanoseconds per pixel), giving a frame refresh rate of 10 Hz (1/100 ms). Various system constraints, however, could reduce the frame refresh rate to as low as 3 Hz for such a high-resolution display.

This leads to a closely related problem, known as flicker. A frame refresh rate of 10 Hz in a display employing conventional (short persistence) phosphor would have an unacceptably annoying flicker. Interlace is commonly used to provide an acceptable flicker level in a display system that has reduced cost due to slower components, i.e the horizontal scan time is roughly doubled in going to a 60 Hz field rate from a 60 Hz frame rate. This can greatly reduce the display system cost and reduces overall system bandwidth requirements, and also results in a 50% (roughly) reduction in transmission spectrum space for commercial TV over a 60 Hz system. Typical displays either sync or operate the field/frame rates at the same (or multiple/sub multiple) as the power line frequencey (60 Hz in the U.S.) to reduce artifacts. Such is the case with standard television, where each of two alternating fields (odd numbered then even numbered lines) is scanned at 60 Hz, yielding a 30 Hz frame refresh rate and resulting in barely perceptable flicker.

The manner in which these problems relate to each other in a high resolution cathodochromic CRT display will now be considered. As noted above, from 40 to 300 exposures per pixel may be required to build contrast. Correspondingly, multiple complete frame exposures allow the image to build contrast over an interval measured in seconds. At the beginning of the process of generating an image, particularly up until the point where the contrast ratio is about 2:1, the contribution to contrast of each successive frame exposure is quite noticeable to the extent that even an infinitely-long persistence cathodochromic CRT has a perceptable flicker, much as a conventional phospher CRT would have at the same frame rate. In a cathodochromic CRT, the flicker effect is manifested in part as an annoyingly visible top to bottom contrast enhancement.

Interlacing can also alleviate the flicker problem in a cathodochromic CRT. With an interlace ratio such that the resultant field rate approaches 30 Hz, the contrast builds and an image gradually appears much as the image on an "instant" photograph appears as it develops.

Another advantage of interlacing is that the heating caused by thermal conduction from adjacent pixels on lines above and below occurs at least one field time (rather than one line time) away, thus reducing the peak temperature of the exposed pixels allowing contrast to build faster and darker.

Interlacing alone does have its limitations in a high resolution cathodochromic CRT display system, due largely to the time required for a complete scan. As a more particular example, in one system in which the present invention is embodied, there are a total of 2048 lines on the display, with 1728 pixels per line. At an exposure of 100 nanoseconds per pixel, multiplication gives an active line time of 172.8 microseconds. Rounding this to 172 microseconds and adding a 10 microsecond horizontal retrace time results in a total time of 180 microseconds per line. Multiplying again by the 2048 lines gives a frame period of 0.369 seconds, which corresponds to a frame refresh rate of 2.7 Hz. This figure is even worse when time for vertical retrace and possible calculations during the vertical retrace interval is taken into account.

To achieve a field refresh rate of 30 Hz under these conditions would require an interlace ratio of about 12:1. At such high interlace ratios other objectional effects can occur, such as an apparently random appearance of spaced lines on the display, instead of the desired effect of having an image gradually appear much as an "instant" photograph.

Moreover, interlacing alone does nothing to speed the overall process of generating an image over 40 to 300 frames, and in fact can slow the process down by introducing multiple vertical retrace delays Related problems arise in two other situations with which the invention is particularly concerned.

The first of these situations is where only partial raster images are available, such as from a line-by-line facsimile transmission. In general, an image builds from top to bottom. However, due to overheating and contrast considerations, lines cannot simply be written to the image target as they are received.

The second of these situations is when manual point-by-point line drawing is implemented to allow an image to be annotated. Overheating and contrast considerations remain, complicated by the random nature of the input.

SUMMARY OF THE INVENTION

Accordingly, it is an object of the invention to optimize line scanning in a long-persistence display system.

It is another object of the invention to reduce flicker and related visually objectionable effects in a long-persistence display system, such as a cathodochromic CRT display system.

It is yet another object of the invention to speed up the overall process of generating a full-contrast, high-resolution image in a cathodochromic CRT display system.

It is another object of the invention to effectively accommodate partial raster images as well as direct manual point writing.

An overall system in which the invention is implemented has several elements, including the display device itself and a digital memory in which a representation of the image is stored prior to display. The invention relates in particular to the manner in which the image is converted from its representation in memory to something visible on the screen.

In accordance with one aspect of the invention, those scan lines which have no picture information are simply skipped as information is read out from the memory an displayed on the screen. Scan lines which have no picture information are, in the case of a cathodochromic CRT, lines which are all white. In the case of a conventional cathodoluminescent CRT, these are lines which are all black. By skipping those lines which have no picture information, the overall image can be generated that much faster, an important consideration in view of the relatively lengthly time required for a complete high-resolution raster scan of a cathodochromic target.

The invention provides a mechanism to generate images at programmable interlace factors of 1:1 to 256:1, or higher, combined with a mechanism for skipping scan lines in the image that contain no picture information (all white lines in the case of the CCRT, all black in a light emitting phosphor CRT or display). This permits as high a field rate a desired for optimum generation of each image.

In addition, the programmable interlace mechanism can be employed alone, quite apart from skipping those lines which have no picture information.

Another aspect of the invention is "rolling writing". In "rolling writing" an image portion is scanned either in a mini-raster containing multiple lines or in a repeating sequence of just a few pixels. The "rolling writing" technique of the invention is applicable either to partial raster images (e.g. from a facsimile transmission), or to annotation.

More particularly, a raster-scanned electronic display system in accordance with the invention includes a display device in turn including a deflection generator which permits writing to at least individual image lines in any order. An image memory is capable of storing pixel data on a line-by-line basis and, in the preferred embodiments, is further capable of storing a skip word corresponding to each line of pixel data. Each skip word indicates a particular successive line to be scanned, and thus which lines to skip.

The system further includes means for writing data to the skip words to establish a sequence of particular lines to scan. The sequence of particular lines to scan may comprise simply a particular sequence for interlacing or, in the preferred embodiments, establishes a sequence which skips image lines, if any, determined to have no picture information. The means for writing data to the skip words is in turn included in a general analysis means, implemented for example in a microprocessor, for determining the lines which have no picture information.

A final element of the system is an image controller connected to the image memory and to the display device for reading pixel data line by line from the image memory and causing display device image lines corresponding to lines stored in the image memory to be written in a raster-scanned pattern. Depending upon the particular implementation, the raster scan pattern skips those lines, if any, determined to have no picture information. In the preferred embodiments employing skip words, the image controller also reads the skip words and determines which successive lines to scan based on the skip words.

A system for "rolling writing" of partial raster images, i.e. for displaying on a cathodochromic CRT a raster-scanned image which becomes available line-by-line over a period of time, more particularly comprises display driving electronics connected to the cathodochromic CRT, the display electronics including a deflection generator which permits writing to individually addressed image lines. The system further includes an image memory capable of storing pixel data on a line-by-line basis, and means for storing incoming image lines in the image memory as they become available.

The system additionally includes window means for periodically selecting a subset of image lines in the image memory, the selected subset including relatively recently-received lines (i.e. new lines), and the selected subset changing with time. Preferably, the window means includes means for selecting a plurality of blocks of lines to constitute the subset, and for adding new lines to the subset in block units, while simultaneously deleting old lines from the subset in the block units.

A system implementing "rolling writing" for annotation, i.e. a system for display on a cathodochromic CRT a series of points which become available as individual pixel elements over a period of time, more particularly comprises display driving electronics connected to the cathodochromic CRT, and including a deflection generator which permits writing to individually addressed pixels. A point refresh buffer memory is included, and has for each of a predetermined number of buffer points, data including pixel position data, and a refresh counter. An image generator means connected to the point refresh buffer and to the display driving electronics for cycling through the point refresh buffer by reading the pixel position data for each point and writing a point on the CRT with an electron beam of predetermined timed duration, maintaining each refresh counter, and terminating writing to each particular point when each of the particular points has been written a predetermined number of times as counted by the refresh counter. Finally, there is included a means for supplying a stream of data describing input points through the refresh buffer to replace data describing input points for which writing has been terminated.

BRIEF DESCRIPTION OF THE DRAWINGS

While the novel features of the invention are set forth with particularity in the appended claims, the invention, both as to orgnization and content will be better understood and appreciated, along with other objects and features thereof, from the following detailed description, taken in conjunction with the drawings, in which:

FIG. 3A is representative image bit map data employed in a discussion of interlacing;

FIGS. 3B and 3C are scan order charts to be read as alternatives in conjunction with FIG. 3A;

FIG. 4A is representative image bit map data including one example of a set of skip winds;

FIG. 4B is a scan order chart to be read in conjunction with FIG. 4A;

FIG. 5A is representative image bit map data including another example of a set of skip words;

FIG. 5B is a scan order chart to be read in conjunction with FIG. 5B;

FIG. 6 depicts a memory organization employed for point-by-point annotation writing; and FIGS. 7 and 8 depict hardware in which the invention is implemented in greater detail.

DETAILED DSCRIPTION

Display Environment

Figure 1:
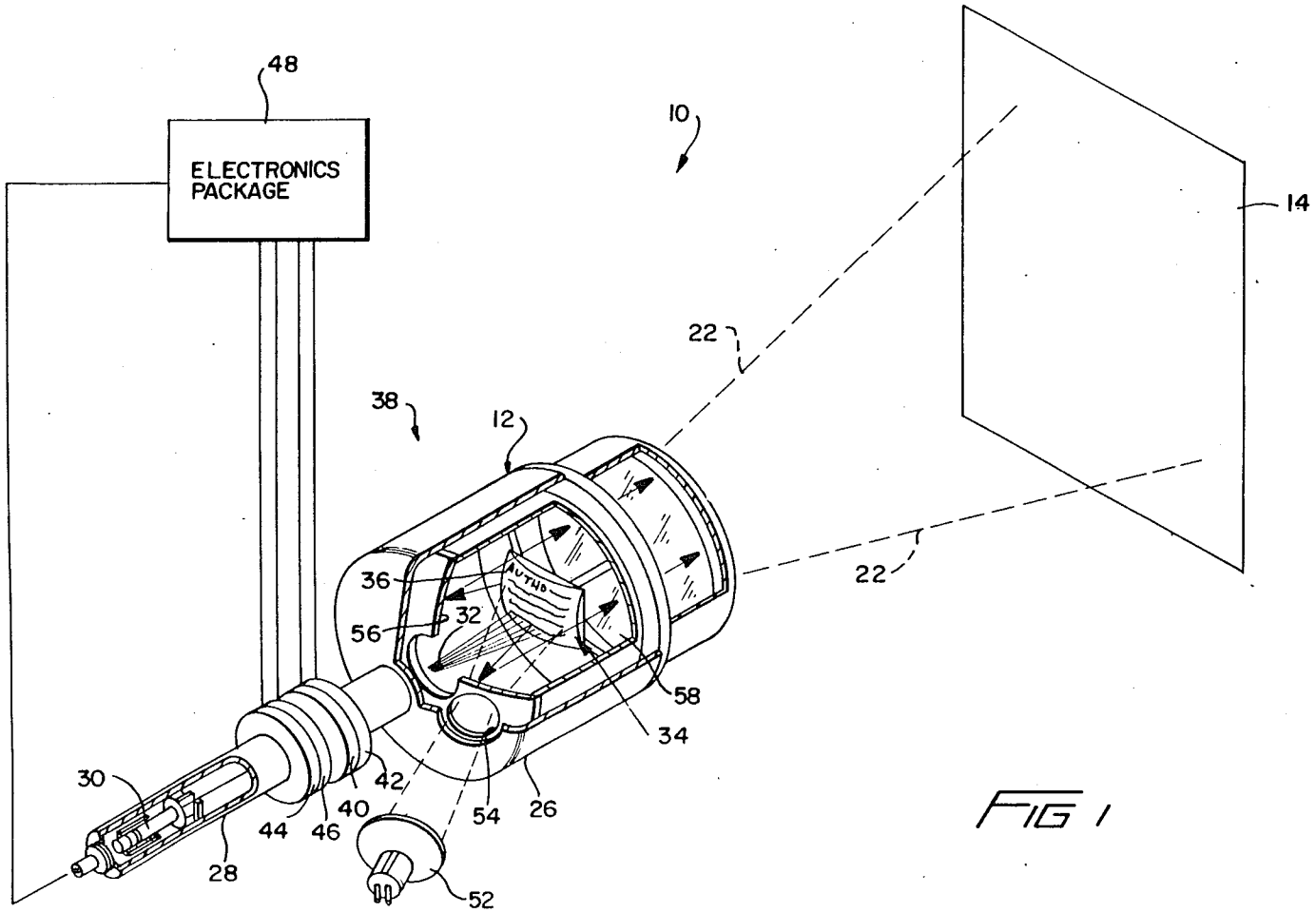
FIG. 1 is a schematic depiction of a cathodochromic CRT projection display system in which the invention may be employed.

Depicted in FIG. 1 is an exemplary long persistence display system in which the present invention may be employed. The particular system 10 is a projection system employing a cathodochromic CRT (CCRT) projection tube 12 for projecting an image on a viewing screen 14. Light rays from the cathodochromic CRT projection tube 12 in general are represented by lines 22. However, it will be appreciated that, while the invention is advantageously employed in a cathodochromic CRT projection system, neither a cathodochromic CRT nor a projection system are necessary in practice of the invention in its broader aspects. The system 10 is intended for high-resolution (e.g. 2048×2048 pixel) high quality single images, such as documents and graphics, which may be presented and discussed, for example, during a teleconferencing meeting.

The cathodochromic CRT projection tube 12 is preferably of the general form disclosed in the above-identified Todd, Jr. U.S. Pat. No. 3,959,584, the entire disclosure of which is hereby incorporated by reference. The cathodochromic CRT 12 includes an enlarged housing portion 26 with an integral neck portion 28. Within the neck 28 is an electron gun 30 which generates an electron beam 32 of controlled intensity directed toward a cathodochromic image target 34. The image target 34 comprises an aluminum support having a rear surface 36 coated with a suitable cathodochromic power, such as a sensitized bromine sodalite $Na_6Al_6Si_6O_{24}2(1\text{-}z)NaX$, wherein z is the fraction of NaX vacancies formed by hydrogen annealing and X is Br or a mixture of Br and OH. A process for preparing such a cathodochromic sodalite is disclosed in Todd, Jr. et al U.S. Pat. No.

3,932,595. As described in Todd, Jr. U.S. Pat. No. 4,959,584, preferably there is an underlying thermal buffer layer between the sensitized sodalite and the underlying support.

As noted above, in contrast to photoluminescent phosphors, cathodochromic materials do not emit light. Rather, they change color when excited by an electron beam. In the case of cathodochromic bromine sodalite, the resultant coloration remains indefinitely, until deliberately erased. In addition to inherent memory, cathodochromic image screens have the properties of high resolution, and high contrast in bright ambient light making them highly suitable for projection systems. Erasure is normally effected by heating to about 300° C. An economical and technically feasible method erasure is electron beam heating, wherein the image screen 34 is scanned, in a raster pattern, with an electron beam energy density such that temperature is raised above an erase threshold.

The cathodochromic CRT 12 is one element of an overall CRT assembly 38, which additionally includes permanently affixed X- and Y-axis electromagnetic deflection coils 40 and 42 of conventional construction, as well as electromagnetic static and dynamic focus coils 44 and 46, respectively. While electromagnetic focus deflection are depicted, the invention is equally applicable to electrostatic focus and deflection systems. The invention is, in general, applicable to any long persistence display system, not necessarily limited to electron beam or CRT systems, and in particular to systems which build contrast over a number of frames. The invention, for example, is also applicable to laser imaging systems (e.g. printers and displays), to certain types of liquid crystal displays, as well as others.

The electron gun 30, and the coils 40, 42, 44 and 46 are driven by circuitry within an electronics package 48 to effect the desired scanning, focusing and intensity control of the electron beam 32.

For displaying an image written on the image screen 34, light from a suitable light source, such as xenon lamp 52 is directed through a suitable windowed aperture 54 to illuminate the image target rear surface 36. Light reflected from the rear surface 36 is collected by a spherical projection mirror 56 and reflected forwardly through a glass face plate 58 generally towards the viewing screen 14. As indicated, the light is projected through a suitable optical projection lens system 59 which includes a Schmidt correction lens to correct spherical aberations in a known manner.

PRINCIPLES OF THE INVENTION

Figure 2:
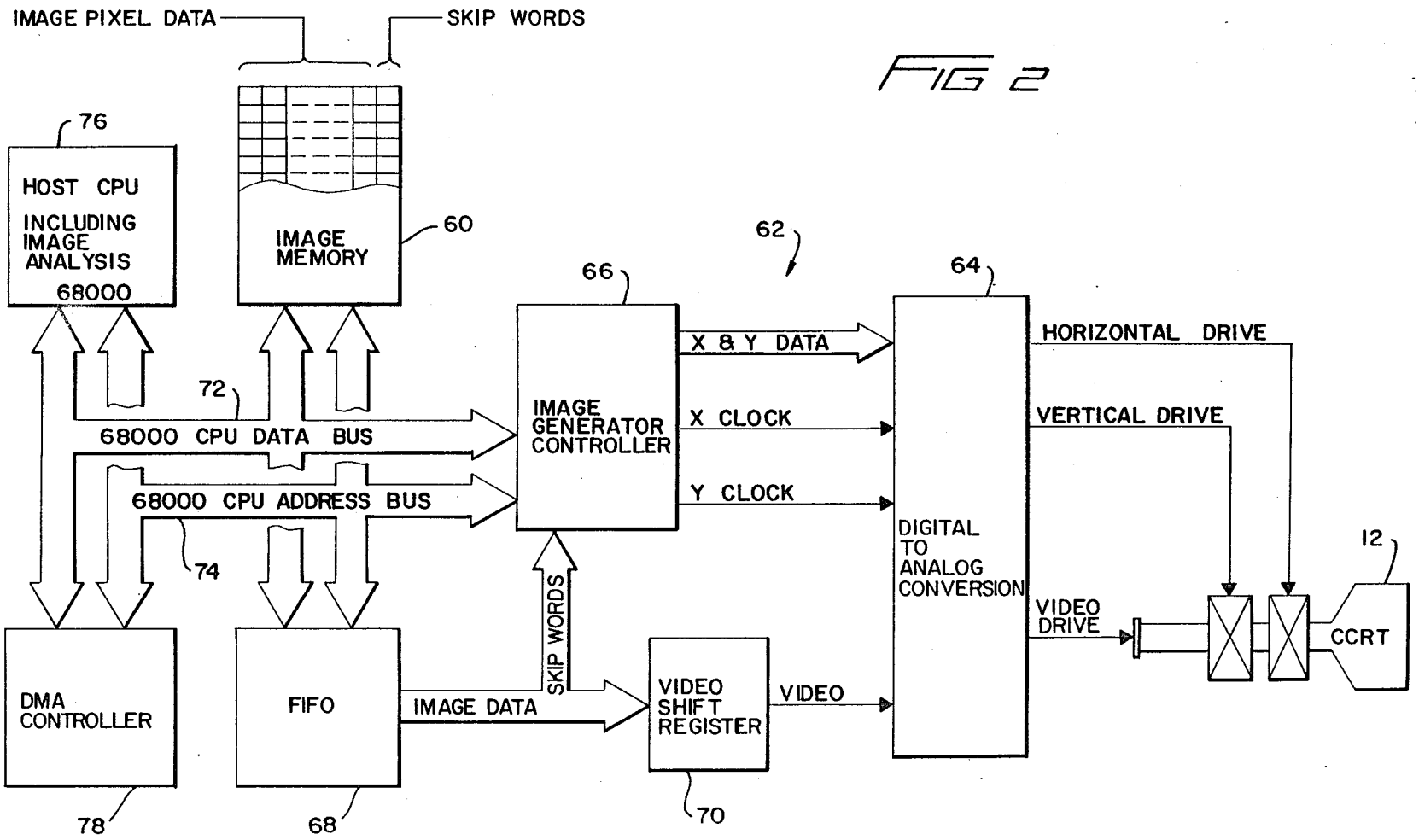
FIG. 2 is an overall block diagram depicting one arrangement of elements in accordance with the invention driving the FIG. 1 projection display system.

With reference now to FIG. 2, depicted is one arrangement of elements in accordance with the invention, including elements within the electronics package 48. In FIG. 2, the cathodochromic CRT (CCRT) of FIG. 1 serves as a display device. An image memory 60 is provided, capable of storing pixel data on a on line-by-line basis, corresponding to the lines to be displayed on the CCRT 12. The image memory 60 may comprise a portion of a larger dynamic random access memory serving other purposes as well. Other significant elements in FIG. 2 are an image generator, generally designated 62, which operates in conjunction with digital to analog conversion circuitry 64 (including suitable drivers, not shown) for driving the deflection elements of the CCRT 12. The basic designs of the image memory 60, the image generator 62 and the digital-to-analog circuitry 64 follow conventional practice, but with a number of modifications to enable them to serve the functions required in the practice of the invention.

The digital to analog conversion circuitry 64 may be viewed as a digitally addressable linear deflection generator, in contrast to flyback type deflection conventionally employed in televisions. The combination of the circuitry 64 with the CCRT 12 permits display lines to be scanned in any order and, more generally, permits an electron beam for writing to be directed to any individual pixel.

While other arrangements may be employed, a particularly advantageous form of image generator 62 is employed herein, which includes an image generator controller 66, a first in first out (FIFO) memory 68 and a video shift register 70. These elements and their operation are discussed in greater detail hereinbelow.

From FIG. 2, it will be seen that the system embodying the invention is microprocessor-based, and includes a conventional bus structure for communication among the various elements. In particular, there is a data bus 72 and an address bus 74, which may also include a control bus, not specifically shown. Connected to and generally controlling the buses 72 and 74 is a suitable microprocessor 76, such as a Motorola Type No. MC68000. To facilitate data flow, a DMA controller 78 is included, which permits high speed data transfers among the various elements, without tying up CPU time. An Hitachi Type No. HD68450 DMA controller is suitable.

An important subsidiary processor is the image generator controller 66, which controls the overall operation of the image generator 62. In general, the image generator 62 is a high speed dedicated sub-system that generates signals to deflect the electron beam along the X- and Y-axis, while modulating the electron beam to produce an image. The image is stored in the image memory 60 which, in the illustrated embodiment, is a portion of general system memory which the image generator 62 has priority high speed access to. In the preferred embodiments, the various functions are, however, somewhat distributed. For example, the main CPU 76 serves an analysis function and accordingly writes data to the image memory 60, and the DMA controller 78 aids significantly in transferring data at high speed from the image memory 60 to the image generator 62.

An important aspect of the invention is the organization in the image memory 60 of image and related data. While based on a conventional raster system, the organization of the data in the memory 60 differs from conventional.

In common with a conventional raster scan system, in the disclosed embodiment of the invention the pixels of a raster scan image are arranged sequentially in memory beginning, for example, at the top left corner of the image and continuing line-by-line. In general, data from the image memory 60 is read by the image generator 62 in synchrony with the electron beam scan in the CCRT 12, with the memory contents determining whether the electron beam is to be turned on or off as it passes a particular pixel.

As one particular example, for a raster image of 1024 lines of 1024 pixels each, and an image memory 60 in which pixel data is stored in 16-bit words, the total memory requirement would be 1024/16 words per line times 1024 lines, resulting in 65,536 words of memory (assuming one bit per pixel). The top scan line would be contained in the first 64 words, the second scan line in the next 64 words, and so on.

A significant departure from convention in accordance with the present invention is an additional word added to each scan line in image memory 60, referred to herein as a "skip word". The "skip word" contains data placed there by either the image generator controller 66 or other processor (e.g. CPU 76) prior to image generation. At image generation time, the image generator controller 66 in effect reads the image memory 60 in synchrony with the electron beam during each scan line, just as in a conventional raster system. However, at the end of the line it reads a skip word and uses that to calculate a subsequent line to be scanned, and moves the electron beam accordingly. Thus, during operation 16-bit-wide pixel data words are transferred by the DMA controller 78 from the image memory 60 to the FIFO 68. The image generator controller 66, by control lines (not shown), causes pixel data words to be read from the FIFO into the video shift register 70 to be clocked out bit by bit. The last memory data word of each line, is not pixel data; rather, it is a skip word. Accordingly, rather than being read into the video shift register 70, the skip words are read from the FIFO 68 into the image generator controller 66 for calculation of a subsequent line to be scanned.

An architecture in which the invention may be implemented is described in greater detail hereinbelow with reference to FIGS. 7 and 8. However, important principles of the invention will be apparent from FIG. 2 in conjunction with the following discussion with reference to FIGS. 3A, 3B, 3C, 4A, 4B, 5A and 5B.

Each of FIGS. 3A, 4A and 5A represents, on a small scale, image bit map data as it would be stored in the image memory 60 for the particular image, and will be understood to correspond line-by-line with a displayed image. FIGS. 3A, 4A and 5A each represent a very small display having 18 lines of 33 pixels per line. Spaces indicate white pixels (not written) and asterisks indicate black pixels.

FIGS. 3A and 3B together depict, for purposes of comparison, a conventional 1:1 (non-interlaced) display. The lines of FIG. 3A are all scanned in sequence top to bottom as indicated by the scan order chart of FIG. 3B. At a 1:1 interlace ratio, there is one scan field in each frame. The sequence repeats for as many frames as are required. With conventional phosphors, an indefinite number of frames are scanned, as the display image disappears as soon as scanning stops. With a long persistence display, as is employed in the practice of the invention, after a finite number of complete frames have been scanned, contrast is built up to a maximum, and scanning can stop.

FIG. 3C is an alternative scan order chart to be read together with FIG. 3A. FIGS. 3A and 3C together depict, for purposes of comparison, a conventional 2:1 interlaced display of the same image. Starting with line 1, the odd-numbered lines are scanned in sequence to define the first field. Then, starting with line 2, the even-numbered lines in sequence are scanned to define the second field. At a 2:1 interlace, there are two fields per full image frame. As noted above, the sequence repeats for as many frames as desired.

As noted in the Background of the Invention, higher interlace factors can be useful in long persistence displays, including storage displays. Since the images are static, a detailed high resolution image can be generated at higher interlace ratios, providing a low resolution image very quickly that then becomes more detailed as the subsequent fields are scanned.

As described above with reference to FIG. 2, an important aspect in the preferred embodiments of the invention is the use of "skip words" to indicate a particular successive line to scan. It will be appreciated that the skip words can be coded in various manners, and that the particular coding described herein is exemplary only.

FIGS. 4A and 4B together depict a 2:1 interlace example employing skip words. The example of FIGS. 4A and 4B generates the same scan sequence and image as the example of FIGS. 3A and 3C, but it does it by employing skip words. In the embodiment described herein, in order to give the image generator controller 66 enough time to do a calculation based on a skip word, each skip word is read one line before it takes effect, as will be apparent from the following example.

Considering the example of FIGS. 4A and 4B, in order to get the process started, the image generator 62 is initialized to an interlace ratio 2:1, and accordingly expects to commence with line 1 to do a field of odd-numbered lines, and then again with line 2 to do a field of even-numbered lines. Accordingly, the image generator 62 first reads the bit map data for line 1 from the image memory 60, and writes it to line 1 of the CCRT 12 display. At the end of line 1, a skip word having a value of 2 is read and temporarily stored within the image generator 62 and the scan is set to line 3, the next odd-numbered line. While line 3 is being scanned, the image generator controller 66 has sufficient processing time to also add the previously-read skip word value of 2 to the current line number (in this case 3), to arrive at a result of 5, as the next line to be scanned. The process thus continues as indicated by the FIG. 4B scan order chart. After line 17 is scanned, the process is repeated for the even-numbered lines, beginning with line 2.

While FIGS. 4A and 4B provide a relatively trivial example, they illustrate the manner in which each skip word indicates a particular successive line to be scanned.

As a less trivial example, FIGS. 5A and 5B together depict the situation where the skip word values also reflect which lines, if any, stored in the image memory 60 have no information, and accordingly can be skipped during the scanning sequence. As noted above, in order to give the image generator controller 62 time to act on the skip words while the process is getting started, the first two lines of each field are scanned, even if they have no picture information.

The scanning sequence depicted in FIGS. 5A and 5B again begins with line 1, which is read from the image memory 60 and written to the screen of the CCRT 12. The skip word having a value of 4 is read, and temporarily stored within the image generator 62. While the skip word having a value of 4 is being processed, scanning proceeds immediately to line 3. While line 3 is being scanned, the image generator controller 62 calculates the line number of the next line to be scanned by adding the skip word value 4 to the current line number 3, to arrive at a result of 7. Thus, the next line scanned in sequence after line 3 is line 7. This process continues through both scan fields, with the image generator controller 62 determining which lines to scan and which to skip, based on the values of the skip words.

In these examples, while field 1 starts with odd and field 2 starts with even lines, the lines in the field will not necessarily be odd in field 1 and even in field 2. In a more general case, the fields may be unbalanced, requiring the processor to level the number of lines each field or create an extra field to accommodate excess lines in certain fields that would take longer than desired to scan, while taking into account the desirability of some form of power line synchronization.

As noted above, skip words may be coded in various alternative manners, without departing from the scope of the invention. In a more general case, the skip word can contain a signed number directing the image generator controller 66 to display a line above or below the last one displayed. Thus, the skip word could provide positional data relative to the last line scanned. A special code could be employed whereby a line would be scanned twice in the current field, making it "bolder" on the display. As another possibility, the skip word could be coded as an absolute line number, rather than as a relative offset.

As the image generator 62 is computing the order of scan lines based on the read skip words, the image generator 62 expects the DMA controller 78 to transfer lines from the image memory 60 to the FIFO 68 in the same order. This is accomplished by having the processor which sets up the skip words in the image memory 60 at the same time generate a conventional link map for the DMA controller 78 which corresponds to this order of lines.

Mentioned but not discussed in detail above is the mechanism which writes the skip words to the image memory 60 in accordance with the desired interlace ratio and in accordance with lines which are to be skipped. This particular mechanism is herein termed "analysis means", and represents one of the functions performed by the CPU 76. It will be appreciated that the functions of the present invention are distributed among the various elements, with great flexibility resulting from the fact that the system is microprocessor-based. Thus, the analysis means comprises the CPU 76 and suitable programming therefor, the algorithm for which is described next below.

Preliminarily, however, it should be noted that the bit-map image is stored in the image memory 60 in an entirely conventional manner, the image being developed from any suitable external source. Initially, the skip words are not set.

An initial step in the routine of the analysis means is to determine which lines, if any, have no picture information. Assuming a binary "0" indicates a particular pixel is off, and a binary "1" indicates a particular pixel is on, the determination of which lines contain no picture information is a relatively trivial one, and involves simply examining the pixel data for each line. If at least one "1" is found, then that line does contain pixel information. If the line is all "0's", then that line contains no picture information.

The next step in the routine of the analysis means is to choose an interlace ratio. The alogrithm attempts, if possible, to select the lowest interlace ratio which will achieve a field rate in the order of 30 Hz. However, the interlace ratio will normally not be permitted to be less than 2:1, in order to avoid the effects of heat conduction between adjacent lines.

Specifically, the number of lines to be scanned is determined by taking the total number of lines in the display (for example 2048), and then subtracting the number of lines determined to have no picture information.

The number of lines to be scanned is multiplied by the scan time per line which, for example, is 180 microseconds. This gives the time required for a complete frame, neglecting, for purposes of simplified example, the time required for vertical retrace. The frame period is then divided by 1/30 seconds, which is the period for a single field. The result, after rounding up to an integer number, is the interlace ratio.

Again, the above example is simplified, because time must also be allowed for the vertical retrace interval, including calculations which may be necessary during the vertical retrace interval.

If the interlace ratio becomes unacceptably high, then the field rate can be reduced to 15 Hz. In order to avoid the effect of any stray 60 Hz AC fields which may enter the system, it is desirable to make the field rate a submultiple of 60 Hz, e.g. 30 Hz or 15 Hz.

While a calculation approach is described just above for determining the interlace ratio, pre-determined calculation results can be stored in a look-up table or similar software technique in order to minimize the time required for calculation.

With the lines to be skipped and the interlace ratio thus determined, the CPU 76 then establishes the skip words in straightforward manner to direct the scanning sequence of the image generator 62 to achieve the desired interlace while skipping blank lines. At the same time, the link map for the DMA controller 78 is correspondingly established.

So that the image generator controller 66 can properly initiate the process of reading lines from the image memory 60, the thus determined interlace factor is also directly communicated to the image genertor controller 66.

Rolling Writing

The discussion up to this point has assumed that the image memory 60 includes pixel data for an entire image before any writing commences. There are two situations addressed by the invention where such is not the case, and specialized techniques are employed.

The first of these situations occurs when only a partial raster-scanned image is available, such as where an image is being received line-by-line in real time from a facsimile transmission over a telephone line, for example, or from a local document scanner or digitizing camera. In general, a facsimile image takes approximately 35 to 40 seconds to arrive. Under these conditions, pixel data is placed line by line into the image memory 60 as it is received. A window of, perhaps, 128 lines is rolled down the image memory 60 bit map. This causes the image to appear gradually from the top down, while building contrast. Due to the overheating considerations discussed in the "Background of the Invention", a single line cannot simply be colored to contrast before moving to the next.

More particularly, a window size is defined comprising, for example, sixteen blocks of eight lines each, for a total of 128 lines in the window. Thus, a window means, embodied in the host CPU 76, selects a subset of image lines in the image memory 60.

Once the image memory 60 has received a sufficient number of lines to generate a window, the image generator 62 begins making repeated scans reading the image pixel data from the image memory 60 and writing to the CCRT 12. When eight additional image lines have been received, enough for a new block, the scanning window is in effect rolled down, picking up the new block, and dropping off the oldest block. In other words, the window means adds lines to the subset of lines comprising the window in units of a block, and deletes old lines from the subset in units of a block. This procedure continues until the entire image has been received. Programmable interlace and skip could be employed in the scanning of the rolling windows, but the processor time required to continually recalculate interlace, configure skips, and build a link map for the DMA controller 78 is excessive.

In most cases, image data arrives from a scanner or similar device and is placed in the image memory 60 at a rate which does not permit writing the CCRT 12 to full contrast, if the system is to present new lines as they are received in essentially real time. Accordingly, after the entire scanned image has been received, the entire image is analyzed and skip words generated as described above, and the system reverts to the previously-described operation to bring the display up to full contrast.

Another situation where it is desired to display incoming data as it is received in as close to real time as practicable is in the case of manual annotation of an image which is currently being displayed. Annotation is implemented employing a direct point writing technique wherein a line on the screen follows a continuous stream of X, Y pixel addresses from an external source such as a graphic digitizer tablet (not shown). A person handwrites on the digitizer tablet and a line appears, apparently simultaneously, on the display. In general, this is accomplished by taking point position information from the graphics tablet in a stream of X, Y positions, translating them into X, Y pixel addresses on the CCRT display, and darkening the address pixels with the electron beam in real time.

This input mode causes the same exposure and heat problems discussed earlier. In general, new points arrive too quickly for each pixel to be written to full contrast. A variation on the rolling writing approach is employed, implemented as a point refresh memory depicted in FIG. 6 and preferably included in the image generator controller RAM 86 (FIG. 7, below).

Depending upon the speed upon which input points are arriving it is not always possible to achieve full contrast. A somewhat arbitrary compromise is adopted wherein 1 millisecond per point is allotted to achieve the best contrast possible in this limited amount of time. In general, this allows approximately 6 to 8 exposures per point. In order to make the line more visible on the screen, the electron beam is defocused for a wider trace, with a commensurate increase in beam energy.

FIG. 6 represents an organization of data in memory herein termed a point refresh buffer, maintained by the image generator 62. As indicated in FIG. 6, a rolling window for annotation contains a number of pixel points, rather than a number of scan lines. In order to keep the hardware requirements reasonable, the technique as implemented employs a relatively small window, of eight points, (an arbitrary figure which may be varied). Each point in the window is represented by a block of memory locations respectively containing the X pixel position, the Y pixel position, and a refresh counter location in which a count of the number of times each particular pixel has been written is maintained. In order to ensure that a particular pixel is not overexposed, and thus erased, a delay factor is also included. If there are a number of points, then the delay factor applies from one point to the next. In the limiting case where there is only one point to be displayed, the delay factor is applied to control successive exposures of that one point. The point refresh buffer could be expanded to include other information, such as video drive data, focus values, settling time from previous points and so on.

The algorithm for point writing will now be considered.

1. First, the image generator 62 positions the electron beam in the CCRT 12 to the pixel address of Point 1.
2. Next, a delay is introduced, to accommodate deflection settling time, plus the Point 1 delay factor time.
3. Next, the electron beam is turned ON then OFF for a predetermined time duration.
4. The refresh count for Point 1 is decremented.
5. In the event the Point 1 refresh counter is zero, then data for a new Point 1 is obtained and placed into point refresh the buffer, if such data is available.
6. The image generator 62 then checks the point refresh buffer for Point 2. If the Point 2 refresh counter is zero, then Point 2 is skipped. Otherwise, the electron beam is positioned to display Point 2, which is displayed as summarized above.

As data for new points arrives, their display addresses are calculated and are held in a separate first-in-first-out memory buffer maintained by the CPU 76, and are passed on demand to the image generator 62 to be placed in the point refresh buffer. The image generator 62 rolls through the point refresh buffer and colors each point the prescribed number of times to build its contrast.

If, as an example, a line is being drawn left-to-right across the screen, at any given time eight points along the line will be in the point refresh buffer. The left-most point being the first received, will finish its refresh first, and be replaced by the next point along the line, and so on, making a tiny window rolling along the line following the pen. In practice, the procedure occurs too fast for the human eye, so contrast differences are not discernable at the leading edge of the line as it is being drawn.

Hardware Details

Figure 7:
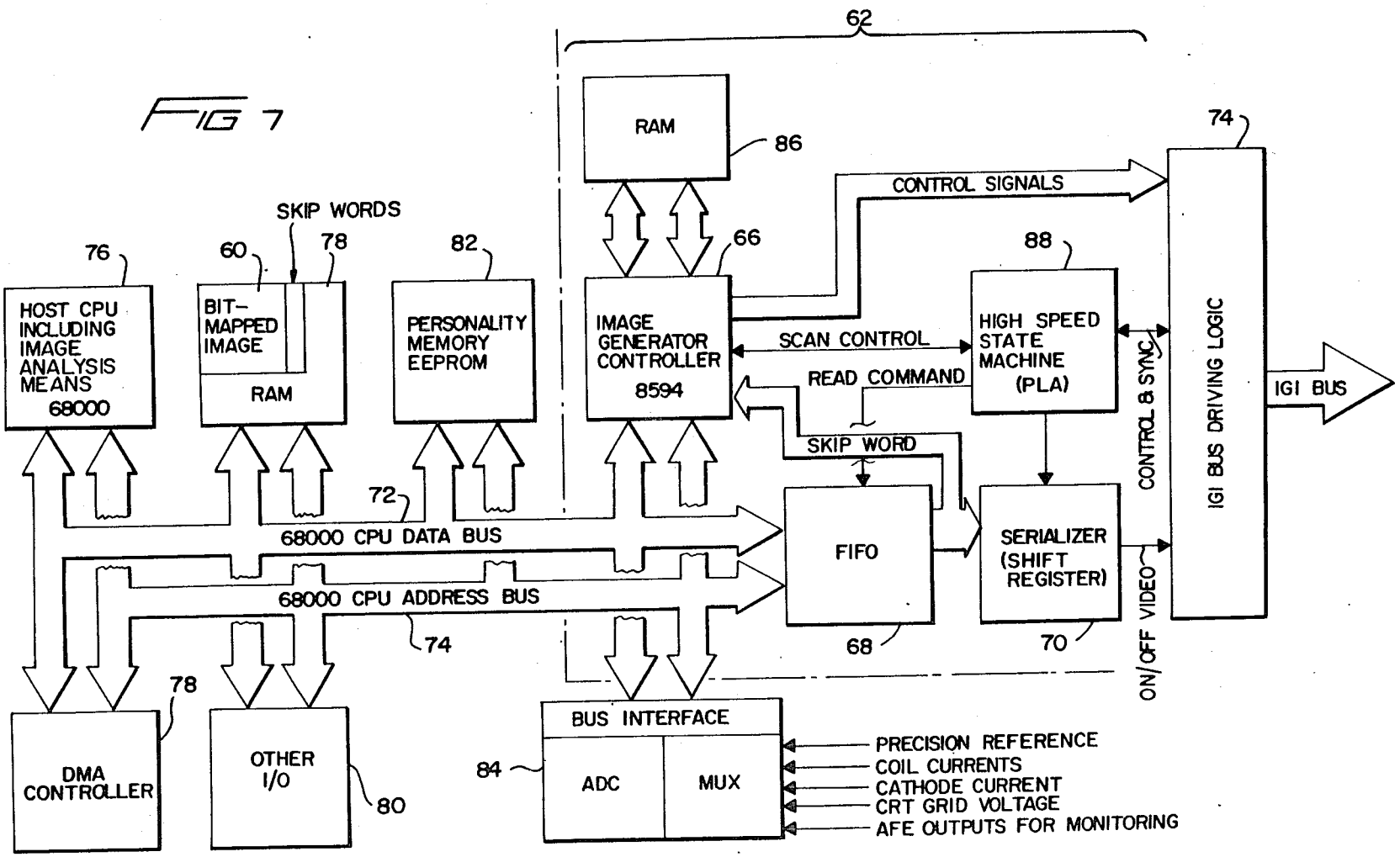

With reference now to FIGS. 7 and 8, a suitable hardware implementation of the system of FIG. 2 is shown in greater detail. FIGS. 7 and 8 herein correspond to FIGS. 3 and 4 of the above-incorporated related application Ser. No. 789,107 to which reference may be had for further details of FIGS. 7 and 8 with which the present invention is not directly concerned.

The digital-to-analog conversion circuitry 64 of FIG. 2 generally corresponds to FIG. 8, which depicts in detail circuitry termed herein an "analog front end" 72. The image generator 62 communicates with the analog front end 72 by way of an "Image Generator Internal" (IGI) bus. The IGI bus is a simplified control bus for causing the loading of various registers in the analog front end circuitry 72 with digital values at appropriate times. The IGI bus is driven by bus driving logic 74 which includes conventional elements such as latches and buffers, and could be implemented, for example, employing conventional. parallel input/output (PIO) compatible with the image generator controller processor 66.

As noted above with reference to FIG. 2, the image memory 60 preferably is a portion of general system memory, shown in FIG. 6 as dynamic RAM 78 connected to the host CPU data and address busses 72 and 74.

Also on the busses 72 and 74, and depicted in generalized form, is a port 80 for "other I/0" which represents interlaced external systems, such as systems for defining an image to be displayed.

Two other elements on the busses 72 and 74, with which the present invention is not directly concerned, are a "personality memory" 82 and sample circuitry 84. These elements are described in much greater detail in the above-incorporated related application Ser. No. 789,107.

Considering the image generator 62 in greater detail, the image generator controller 66 is preferably a special high speed processor dedicated to operating the display and performing its functions with a minimum of involvement by the host CPU 76. It should be noted that the designs of the FIG. 7 image generator 62 and the FIG. 8 analog front end 72 are interdependent and may be altered considerably, particularly at the interface between the two subsystems.

To implement the image generator controller 66, a Zilog Type No. 8594 "Universal Peripheral Controller" is employed. The 8594 is a specialized processor which appears to the 68000 host CPU 76 as twenty registers in the 68000 address space.

Connected to the 8594 controller 66 is a RAM 86 in which program and data are stored during operation. Upon system reset, it is a characteristic of the 8594 that it expects data (including program data) to be uploaded via selected ones of its twenty registers into the RAM 86. Thus, as a part of the system initialization procedure, the host CPU 76 uploads this data from the EEPROM memory 82 into the RAM 86.

To provide ON/OFF video at a pixel clock rate of 10 MHz, corresponding to a period of 100 nanoseconds, the sixteen bit-wide first-in-first-out (FIFO) memory 68 is connected to the address and data busses 72 and 74 to receiver image data, and a serializer 68 is connected to the output of the FIFO 68. Operation of the FIFO 68 and serializer 72 is coordinated by a high speed state machine 88, implemented in a programmable logic array (PLA), which simply acts as a high speed clock and timing generator, under the overall control of the controller 66. The controller 66 has a connection (not shown) to the DMA controller 78 to cause image data to be transferred at high speed from the bit-mapped image memory 60 to the FIFO 68 until the FIFO 68 is full. This architecture permits the use of a slower but wider RAM for the bit map 60 which can be read at conventional speeds since multiple pixels are read at one time, while at the same time accommodating relatively high speed pixel output.

During electron beam erase operation image data is not relevant, and the input to the serializer 70 is forced to a logic "1".

With reference now to FIG. 8, the analog front end 72 generally comprises a digital to analog interface section 200 and a polynomial expansion function generator section 202 which accepts X and Y digital position coordinate data, and applies appropriate geometry correction to generate drive signals for the focus and deflection elements of the CRT 12. In general, the analog front end 72 may be described as an integrated digital to analog control board which drives the cathodochromic CRT display tube 12. The analog front end 72 provides functions such as electron beam positioning, focusing and control of video drive levels.

An important hardware device, a number of which are employed in the analog front end 72, is a multiplying digital to analog converter (MDAC). A suitable MDAC is an Analog Devices Type No. AD7524, which includes an 8-bit data register. Each MDAC has an analog input and an analog output. The output voltage (assuming current-to-voltage conversion as required) is equal to the input voltage multiplied by an attenuation factor determined by the value stored in the 8-bit register. The MDAC registers are connected to the IGI bus, and individually addressed via suitable address decoding circuitry (not shown). In the symbology of FIG. 8, each MDAC is represented by a box having a term in parenthesis, which represents the coefficient value stored in the register, as communicated through the IGI bus in a conventional manner. Several of the MDACs are used to provide offsets and have an analog input represented as "1.0", which designates simply a fixed reference voltage such that the output of the particular MDAC directly represents the register value times the reference voltage.

Considering the digital-to-analog interface section 200 in greater detail, for receiving the digital position data, an X-counter/latch 204 and a Y-counter/latch 206 are provided and appropriately connected to the IGI bus. Conveniently, each of the counter/latches 108 and 110 comprises an 11-bit counter which can be configured to count in an up or down mode. Considerng the X-channel, for example, this allows the display to be conveniently scanned from left to right or right to left.

Immediately following the X-counter latch 204 is a digital-to-analog converter 208 for the X channel, and a similar digital-to-analog converter 210 for the Y channel follows the Y counter 210. The output of the X DAC 208 is an analog representation of a desired X-axis position, and is applied to various points within the polynomial expansion function generator section 202 as indicated. Although not specifically shown, it will be appreciated that level converters are included where required, depending upon the particular components selected.

The output of Y DAC 210 is similiarly an analog representation of a desired Y-axis position. For proper compensation, an offset Y-axis representation, Y', is required, as well as inverted offset Y-axis representation, Y'. To generate these, an analog summation element 212 is provided having its inputs connected to the Y signal and to the output of an MDAC 214 outputting a representation of a value INITIAL Y OFFSET, and having its output connected to an inverter 216.

Also connected to the IGI bus is a 12-bit digital-to-analog converter (DAC) 218 for providing a STATIC FOCUS signal. An internal register (not shown) within the static focus DAC 218 is loaded with a constant value for the particular mode of operation. Different focus values are employed for writing and erasure. The output of the DAC 218 is connected through a suitable line driver (not shown) and then through the FIG. 2 a power amplifier (not shown) to drive appropriate control elements of the CRT 12, specifically, the static focus coil 44.

A video amplifier 200 is included, the output of which is connected in a conventional manner to the cathode and control grid of the CRT 12. In the system depicted, no gray scale is employed, and individual pixels are either OFF or ON. The drive level for an ON pixel, and also drive level for electron beam erase, is established by a signal level applied to an analog input 222 of the video amplifier 220. This input is supplied by another 12-bit DAC 214, comparable to the DAC 218. To complete the video drive circuitry, the ON/OFF video drive line from the FIG. 3 serializer 110 is connected to a BLANK/UNBLANK input 226 of the video amplifier.

It will be appreciated that this video circuitry is exemplary only. For example, multi-level (gray scale) video can be provided by combining the outputs of a relatively fast DAC for modulation and a relatively slower but larger DAC for establishing a base level.

The function generator section 202 of FIG. 8 in general generates geometry correction polynomials which dynamically vary as a function of X and Y screen positions. These are described in greater detailing the above-incorporated related application Ser. No. 789,107, and are only briefly summarized herein.

More particularly, the geometry correction polynomial for the X channel is as follows:

$$XDEFL=D\,(X+AX^3\pm BXY'+CXY'^2+XOFFSET)$$

The coefficients A, B, C, D and XOFFSET are employed as constants, while X and Y' are screen position data.

The above-polynomial for XDEFL is generated by the elements within a function generator 228.

The geometry correction polynomial for the Y channel is similar, and is as follows:

$$YDFFL=H\,(Y'+EY'^3\pm IFY'^2+GY'X^2+OFFSET)$$

Again, the coefficients E, F, G, H and YOFFSET are employed constants.

The above polynomial for YDEFL is generated by elements within a function generator 230.

Following the function generators 228 and 230 are suitable drivers and power amplifiers (not shown) connected to control elements of the CCRT 12.

For dynamic focus, a polynomial function generator 232 generates the function:

$$DF\ DEFL=I\,(X''^2+y''^2+DFOFFSET)$$

where $X''=X+DF\ XOFFSET$ and $Y''=Y+DF\ YOFFSET$

The manner in which the image generator 62 of FIG. 7 and the analog front end 72 of FIG. 8 operate together to drive the display will now be considered. To begin a scan line, the CPU 66 sets the X- and Y-counter/latch registers 204 and 206, and then triggers a cycle of the high speed state machine 88, which cycles at a rate of 10 MHz through n sets of 16 states each to generate appropriate timing signals for a scan line containing n×16 pixels. Included in the control lines is an XCLOCK signal, which clocks the X COUNTER/LATCH 204 to drive the electron beam horizontally at a constant rate. At the same time, data is clocked from the shift register 70 into the video amp 220, the shift register 70 having been loaded from the FIFO 68. The shift register 70 can hold 16 bits at a time. To reload the shift register 70 so that video can continue uninterrupted, at the 13th clock pulse, a FIFO 68 read cycle is initiated. The FIFO 68 comprises Mostek Type No. MK4501 devices, and the shift register 70 comprises conventional digital video shift registers which are intended to operate together in this matter.

While the shift register 70 is reading data from the FIFO 68, the DMA controller 78 reads 16-bit words from the bit-mapped image RAM 60 and loads these words into the FIFO 68.

At the conclusion of a scan line, the image generator controller 66 sends a "count done" signal, and the serializer 70 completes its current cycle. At this point, a "skip word" is available to the image generator controller 66, which is then employed to determine a subsequent line to be scanned.

While specific embodiments of the invention have been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. A display system comprising:

a display device including a deflection generator which permits writing to individual image lines in any order;

an image memory capable of storing pixel data on a line-by-line basis, each line comprising a plurality of pixels;

analysis means for determining which lines, if any, stored in said image memory have no pixels to be written to said display device and for storing in the image memory in association with each line of pixel data a skip word, the skip word indicating a particular successive line to be subsequently scanned; and image generator means connected to said image memory and to said display device for reading pixel data line-by-line and the associated skip words from said image memory and for causing display device image lines corresponding to lines stored in said image memory to be written in accordance with the skip words in a raster scan pattern which skips those lines, if any, determined to have no pixels to be written to said display device, whereby the image is produced on the display device in less time than would be required if all image lines were scanned.

2. A system in accordance with claim 1, wherein said analysis means includes means for determining an appropriate interlace ratio, and wherein said image generator means includes automatic means for establishing a raster scan pattern consistent with the determined interlace ratio.

3. A system in accordance with claim 2, wherein:

said analysis means includes means for writing data to said skip words in accordance with the lines, if any, determined to have no pixels to be written to said display device, and in accordance with the determined interlace ratio; and wherein said image generator means includes means for reading skip words and automatically determining which successive lines to scan based on the read skip words.

4. A system in accordance with claim 1, wherein said display device comprises a cathodochromic CRT.

5. A display system with programmable interlace and wherein n interlaced fields are scanned for a complete frame, where n is any integer, said system comprising:

a display device including a deflection generator which permits writing to individual image lines in any order;

an image memory capable of storing pixel data on a line-by-line basis and of storing a skip word associated with each line of pixel data, each line comprising a plurality of pixels and each skip word comprising data for indicating a particular successive line to be subsequently scanned;

means for writing data to said skip words to establish a sequence of particular lines to scan for each interlaced field; and image generator means connected to said image memory and to said display device including said deflection generator for reading pixel data and skip words line-by-line from said image memory and causing display device image lines corresponding to lines stored in said image memory to be written in a raster-scan pattern, while determining which successsive lines to scan based on the read skip words, whereby the image is produced on the display device in less time than would be required if all image lines were scanned.

6. A system in accordance with claim 5, which includes analysis means for determining which lines, if any, stored in said image memory have no pixels to be written to said display device, and for writing skip words such that said image generator means skips lines determined to have no pixels to be written to said display device.

7. A system in accordance wiht claim 5, wherein said display device comprises a cathodochromic CRT.

8. A system in accordance with claim 6, wherein said display device comprises a cathodochromic CRT.

9. A system for displaying on a display device a raster-scanned image which becomes available line-by-line over a period of time, said system comprising:

display driving electronics connected to said display device including a means which permits writing to individually addressed image lines;

an image memory capable of storing pixel data on a line-by-line basis;

means for storing incoming image lines in said image memory as they become available;

window means for selecting a subset of image lines in said image memory on a regular periodic basis, the selected subset comprising a plurality of successive blocks of successive image lines, each line covering the entire width of the display device, each block comprising a predetermined number of lines and the selected subset including relatively recently-received lines, the window means including means for changing the selected subset with time such that as each new block of lines becomes available the new block is added to the selected subset and an oldest block of lines is deleted from the selected subset; and image generator means connected to said image memory and to said display driving electronics for repetitively reading said selected subset of lines from said image memory and causing image lines corresponding to said selected subset of lines to be written.

10. A system in accordance with claim 9, wherein said display device is a cathodochromic CRT.

11. A system for displaying on a cathodochromic CRT a series of points which become available as individual pixel coordinates over a period of time, said system comprising:

display driving electronics connected to said CRT, including a deflection generator which permits writing to individually addressed pixels;

a point refresh buffer memory including data for each of a predetermined number of buffer points, the data for each point including pixel position and a refresh counter;

image generator means connected to said point refresh buffer and to said display driving electronics for cycling through said point refresh buffer by reading the pixel position data for each point and writing a corresponding point on the CRT with an electron beam of predetermined time duration, changing each refresh counter in a direction towards a predetermined number, and terminating writing to each particular point when each said particular point has been written the predetermined number of times as counted by the corresponding refresh counter; and means for supplying a stream of data describing input points to said point refresh buffer to replace data describing input points for which writing has terminated.

* * * * *